US010501220B2

(12) United States Patent
Sassi et al.

(10) Patent No.: US 10,501,220 B2
(45) Date of Patent: Dec. 10, 2019

(54) STATION FOR PICKING UP AND DELIVERING SHAPED SHEETS THAT DEFINE BOX-LIKE BODIES OF DIFFERENT TYPES

(71) Applicant: GIMA S.P.A., Zola Predosa (IT)

(72) Inventors: Fabio Sassi, Zola Predosa (IT); Franco Mantovani, Zola Predosa (IT)

(73) Assignee: GIMA S.P.A., Zola Predosa (IT)

( * ) Notice: Subject to any disclaimer, the term of this patent is extended or adjusted under 35 U.S.C. 154(b) by 0 days.

(21) Appl. No.: 15/762,972

(22) PCT Filed: Oct. 6, 2016

(86) PCT No.: PCT/EP2016/073913

§ 371 (c)(1),
(2) Date: Mar. 23, 2018

(87) PCT Pub. No.: WO2017/060375

PCT Pub. Date: Apr. 13, 2017

(65) Prior Publication Data

US 2019/0084709 A1 Mar. 21, 2019

(30) Foreign Application Priority Data

Oct. 8, 2015 (IT) ..... 102015000059424

(51) Int. Cl.
*B65H 3/08* (2006.01)
*B65B 43/18* (2006.01)
(Continued)

(52) U.S. Cl.
CPC ..... *B65B 43/185* (2013.01); *B65B 5/024* (2013.01); *B65B 43/10* (2013.01); *B65B 43/285* (2013.01);
(Continued)

(58) Field of Classification Search
CPC .... B65H 3/0808; B65H 3/085; B65H 3/0858; B65H 3/0875; B65H 3/0883; B65H 5/12;
(Continued)

(56) References Cited

U.S. PATENT DOCUMENTS 5,715,657 A * 2/1998 Mondani ..... B31B 50/80 53/457
6,101,787 A * 8/2000 Brintazzoli ..... B65B 43/185 271/11
(Continued)

FOREIGN PATENT DOCUMENTS

EP 0234228 A2 9/1987
EP 0490084 A2 6/1992
(Continued)

OTHER PUBLICATIONS

International Search Report dated Dec. 1, 2016 re: Application No. PCT/EP2016/073913, pp. 1-3, citing: WO 2007/015049 A1, EP 0 234 228 A2, WO 96/20826 A and EP 0 490 084 A2.
(Continued)

*Primary Examiner* — Ernesto A Suarez
(74) *Attorney, Agent, or Firm* — Cantor Colburn LLP

(57) ABSTRACT

A station for picking up and delivering shaped sheets that define box-like bodies of different types includes a magazine for the sheets and at least one handling element for at least one sheet at a time.
The magazine accommodates a plurality of mutually aligned and juxtaposed sheets and the at least one handling element includes an end bracket provided with at least one grip element and at least one assembly with arms which are articulated with respect to the bracket and are independently movable with respect to a fixed frame. The bracket can move between a first configuration of alignment with the end sheet accommodated in the magazine, in the condition where the at least one grip element is in contact with the end sheet, and
(Continued)

a second configuration of alignment with a conveyance line of the sheets which corresponds to the delivery region.

9 Claims, 4 Drawing Sheets

(51) Int. Cl.

| | |
|---|---|
| ***B65H 3/10*** | (2006.01) |
| ***B65H 3/42*** | (2006.01) |
| ***B65B 5/02*** | (2006.01) |
| ***B65B 43/10*** | (2006.01) |
| ***B65B 43/28*** | (2006.01) |
| *B65B 59/00* | (2006.01) |
| *B31B 50/06* | (2017.01) |

(52) U.S. Cl.
CPC ..... *B65H 3/0808* (2013.01); *B65H 3/0883* (2013.01); *B65H 3/10* (2013.01); *B65H 3/42* (2013.01); *B31B 50/06* (2017.08); *B31B 50/062* (2017.08); *B65B 59/00* (2013.01); *B65H 2403/531* (2013.01); *B65H 2403/543* (2013.01); *B65H 2406/345* (2013.01); *B65H 2701/176* (2013.01)

(58) Field of Classification Search
CPC ..... B65H 5/14; B65H 29/32; B65H 33/16; B65H 33/18; B65H 2405/53; B65H 2405/531; B65H 2405/54; B65H 2405/541; B65H 2405/55; B65H 2405/551; B65H 2405/552; B65H 2405/583; B65H 2405/584; B65H 2406/34; B65H 2406/344; B65H 2406/345; B65H 2406/3452; B65H 2406/3454; B65B 43/18; B65B 43/185; B65B 43/305; B65B 43/325; B31B 50/804; B31B 50/062
See application file for complete search history.

(56) References Cited

U.S. PATENT DOCUMENTS

| | | | | |
|---|---|---|---|---|
| 6,620,085 | B2 * | 9/2003 | Gambetti | B65B 43/185 493/125 |
| 8,047,530 | B2 * | 11/2011 | Harston | B65B 43/185 271/100 |
| 2007/0257416 | A1 * | 11/2007 | Ford | B65B 43/185 271/91 |
| 2017/0001740 | A1 * | 1/2017 | Richard | B65B 43/185 |
| 2018/0215118 | A1 * | 8/2018 | Sassi | B65B 43/165 |

FOREIGN PATENT DOCUMENTS

| | | | |
|---|---|---|---|
| WO | 9620826 | A1 | 7/1996 |
| WO | 2007015049 | A1 | 2/2007 |

OTHER PUBLICATIONS

Written Opinion dated Dec. 1, 2016 re: Application No. PCT/EP2016/073913, pp. 1-5, citing: WO 2007/015049 A1, EP 0 234 228 A2, WO 96/20826 A and EP 0 490 084 A2.

* cited by examiner

STATION FOR PICKING UP AND DELIVERING SHAPED SHEETS THAT DEFINE BOX-LIKE BODIES OF DIFFERENT TYPES

TECHNICAL FIELD

The present disclosure relates to a station for picking up and delivering shaped sheets that define box-like bodies of different types.

BACKGROUND

In particular the use is known of two different types of shaped sheets (blanks) for providing box-like bodies that are generally parallelepiped in shape.

In some cases shaped sheets are used (which are cut according to a preset shape, generally by way of a punching process), which, following adapted folding and gluing operations, take on the desired box-like shape structure. In this case the shaped sheets are generally referred to as "flat sheets".

In other cases the shaped sheets, which define the blank to be folded further in order to provide the box-like body, have already been subjected to a first operation of folding and gluing. This second type of shaped sheets, referred to as "pre-glued", has a tubular shape structure and, for storage, is collapsed with respect to two mutually opposite edges.

Both types of shaped sheets ("flat sheets" and "pre-glued sheets") offer numerous mutually competing advantages and therefore makers of machines for packaging have developed several models for operating solely with one type or the other.

The huge difference in encumbrances of "flat sheets" with respect to "pre-glued sheets" in fact determines the need to adopt very different implementation architectures for the stations designed for the pickup and delivery of the sheets, which translate to different elements for movement.

SUMMARY

The aim of the present disclosure is to solve the above mentioned drawbacks, by providing a station for picking up and delivering shaped sheets that define box-like bodies of different types, which is adapted in particular to operate interchangeably on "flat sheets" and on "pre-glued sheets".

Within this aim, the disclosure provides a station for picking up and delivering shaped sheets that define box-like bodies of different types, which has a simple structure and shape.

The disclosure also provides a station for picking up and delivering shaped sheets that define box-like bodies of different types, which adopts universal movement means.

The disclosure further provides a station for picking up and delivering shaped sheets that define box-like bodies of different types, which is different from conventional stations.

The disclosure provides a station for picking up and delivering shaped sheets that define box-like bodies of different types, which is low cost, easily and practically implemented, and safe in use.

This aim and these and other advantages which will become better apparent hereinafter are achieved by providing a station for picking up and delivering shaped sheets that define box-like bodies of different types, of the type comprising a magazine for said sheets and at least one handling element for at least one sheet at a time, characterized in that said magazine accommodates a plurality of mutually aligned and juxtaposed sheets and said at least one handling element comprises an end bracket provided with at least one grip means and at least one assembly with arms which are articulated with respect to said bracket and are independently movable with respect to a fixed frame, said bracket being movable between a first configuration, of alignment with the end sheet accommodated in said magazine, in the condition where said at least one grip means is in contact with said end sheet, and a second configuration, of alignment with a conveyance line of said sheets which corresponds to the delivery region, each arm of each assembly being rotatable and independently movable with respect to the fixed frame of the station, by virtue of the action of a respective motor device, with respect to a common single rotation axis, said motor device being of the type preferably chosen from among controlled electric motors, controlled brushless motors, actuation systems constituted by motors and camshafts and the like.

BRIEF DESCRIPTION OF THE DRAWINGS

Further characteristics and advantages of the disclosure will become better apparent from the detailed description that follows of a preferred, but not exclusive, embodiment of the station for picking up and delivering shaped sheets that define box-like bodies of different types, according to the disclosure, which is illustrated by way of non-limiting example in the accompanying drawings, wherein.

DETAILED DESCRIPTION OF THE DRAWINGS

Figure 1:
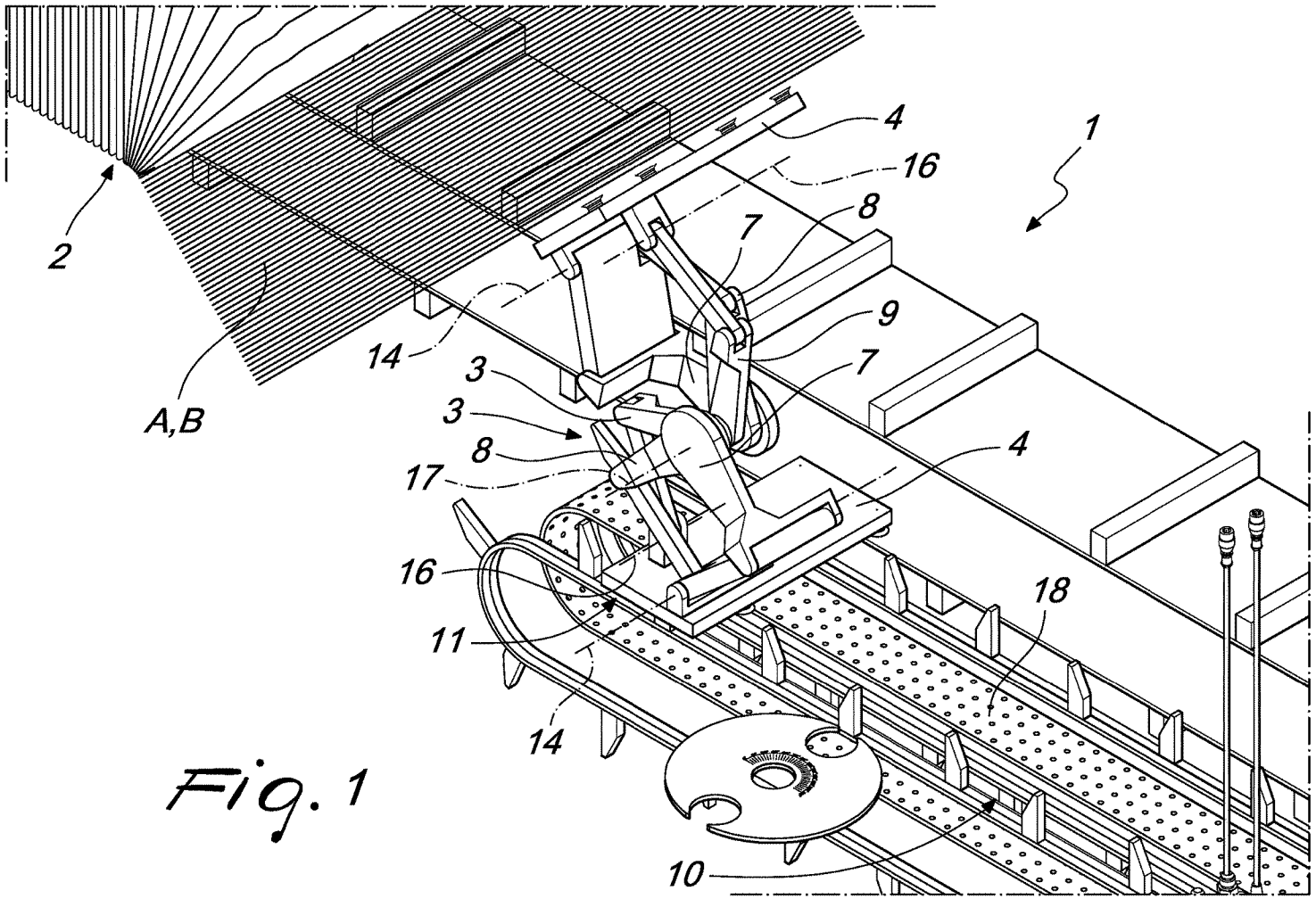
FIG. 1 is a perspective view of a station for picking up and delivering shaped sheets that define box-like bodies of different types, according to the disclosure.
Figure 2:
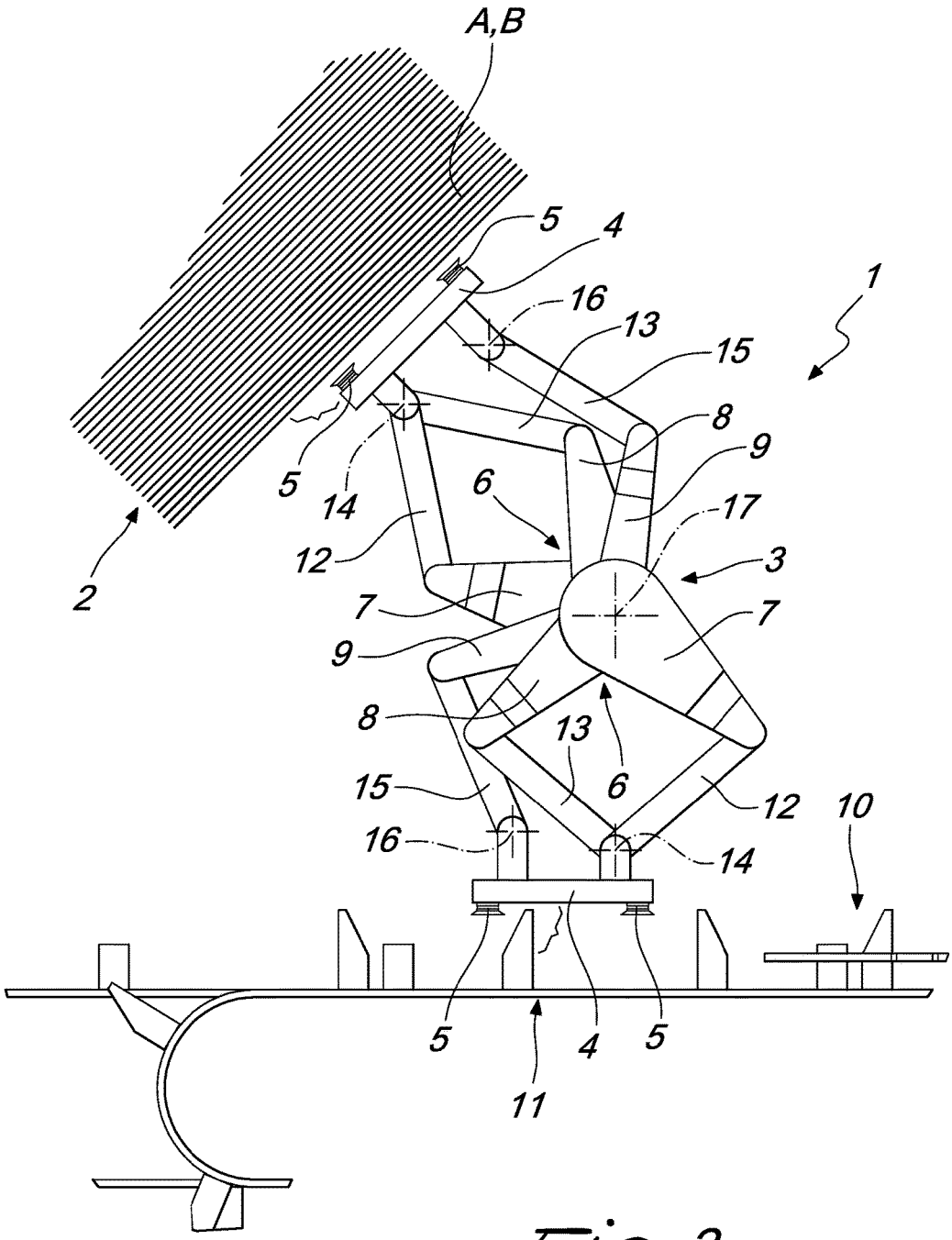
FIG. 2 is a side view of the station of FIG. 1 according to the disclosure.
Figure 3:
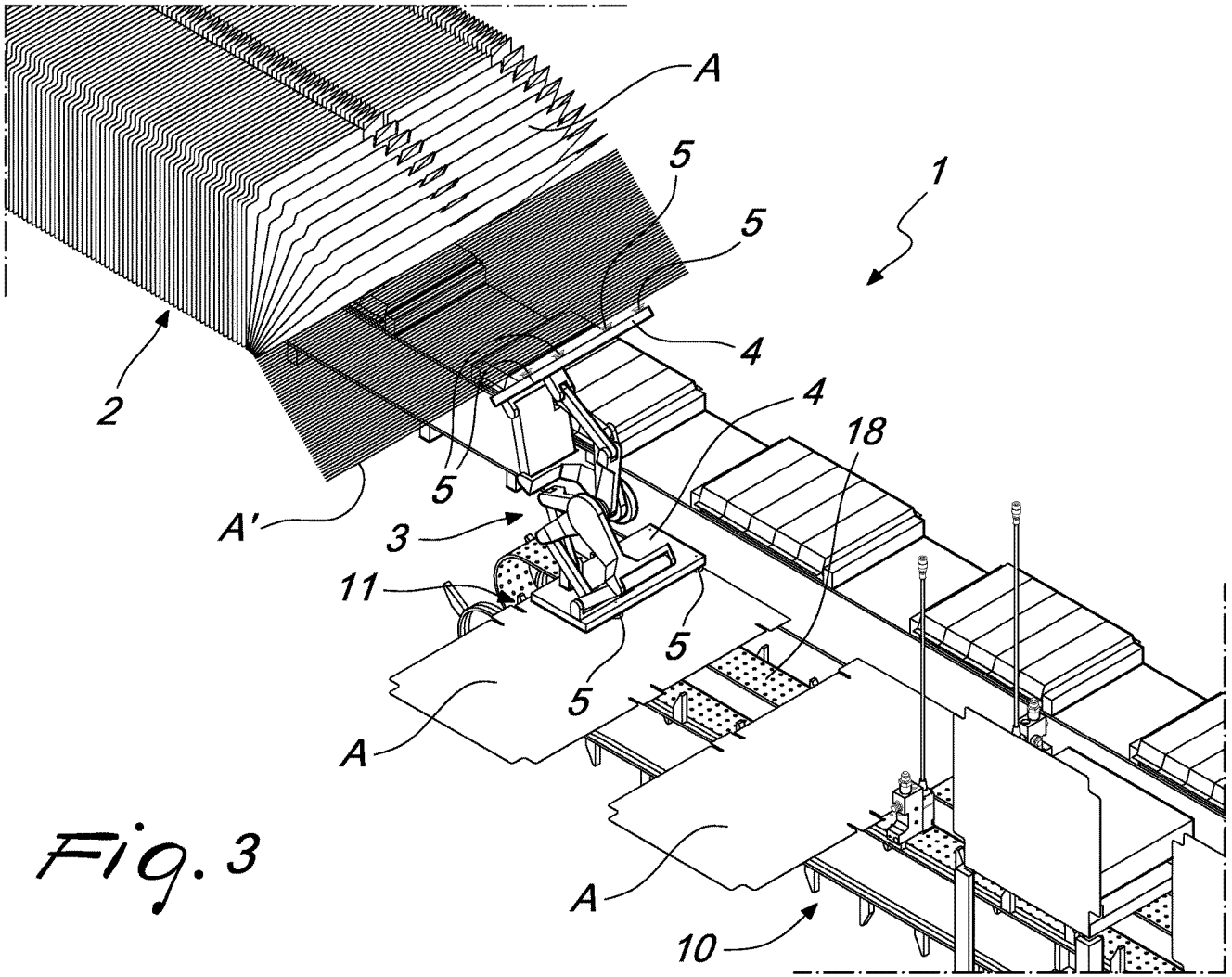
FIG. 3 is a perspective view of a station as in FIG. 1 operating on flat shaped sheets.
Figure 4:
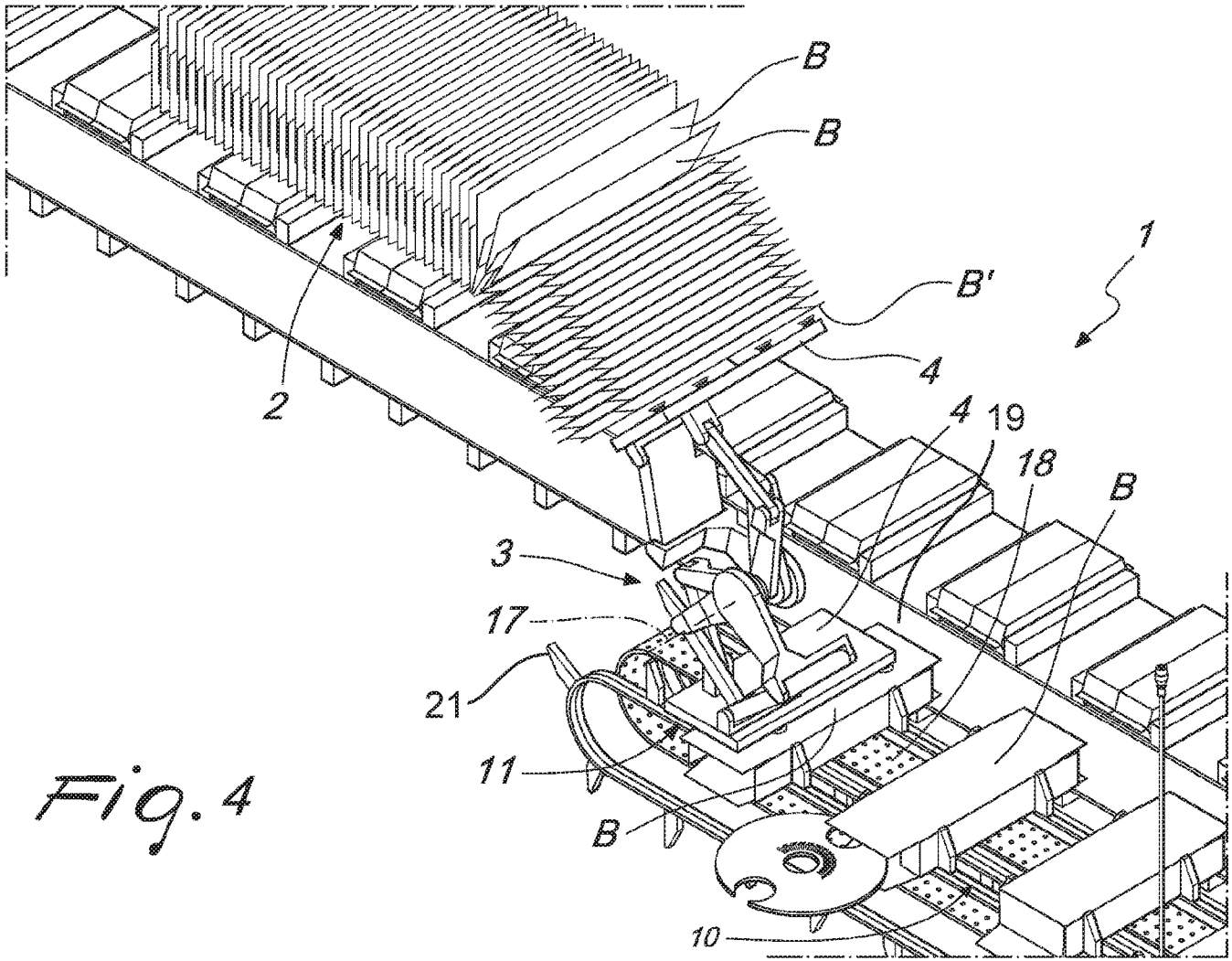
FIG. 4 is a perspective view of a station as in FIG. 1 operating on pre-glued shaped sheets.

With reference to FIGS. 1-4, the reference numeral 1 generally designates a station 1 for picking up and delivering shaped sheets A, B that define box-like bodies of different types.

The station 1 comprises a magazine 2 for the sheets and at least one handling element 3 for at least one sheet A, B at a time.

The magazine 2 accommodates a plurality of sheets A, B, mutually aligned and juxtaposed.

Generally the magazine 2 will accommodate only sheets A (i.e. "flat sheets") or only sheets B (i.e. "pre-glued sheets"); however, the possibility is not ruled out that, in particular embodiments of the present disclosure the magazine 2 can contain an alternation of sheets A and B (arranged according to any logic of alignment and juxtaposition).

According to the disclosure, the at least one handling element 3 comprises an end bracket 4 provided with at least one grip means 5 and at least one assembly 6 with arms 7, 8 and 9 which are articulated with respect to the bracket 4 and are independently movable with respect to a fixed frame 19.

It is useful to point out that the bracket 4 will therefore be able to move between a first configuration of alignment with the end sheet A', B' accommodated in the magazine 2, in the condition where the at least one grip means 5 is in contact with the end sheet A', B', and a second configuration of alignment with a conveyance line 10 of the sheets A, B which comprises the delivery region 11.

It should be noted that the arms 7, 8 and 9, which are independently movable with respect to the fixed frame 19 of the station 1, are three in number.

The two first arms 7 and 8 are pivoted to respective linkages 12 and 13 both of which have the end pivoted to the bracket 4 according to a same first rotation axis 14.

The third arm 9 is pivoted to a rod 15 the free end of which is engaged rotatably with the bracket 4 with respect to a second rotation axis 16.

In practice, by way of relative movements of each arm 7, 8 and 9, it is possible to move and orientate the bracket 4 according to three separate degrees of freedom, allowing the movement of sheets A, B of any size (according to the dimensions of the sheet A, B handled, the path followed by the bracket 4 in order to pass from the first to the second configuration will change in each instance).

It is useful to point out that, according to an embodiment of undoubted applicative interest, the at least one grip means 5 is of the suction type, of the type preferably chosen from among a sucker, a substantially belt-shaped element with suction holes, and the like.

This embodiment is particularly efficient since it makes it possible to activate and deactivate the suction according to the operating step, thus facilitating the operations to hold and release the sheet A, B and ensuring the stability thereof during the transfer from the magazine 2 to the delivery region 11.

In order to increase the speed of the station 1 and, as a consequence, the efficiency of the machine within which it is integrated, the assemblies 3 with articulated arms 7, 8 and 9 can in some cases be at least two in number, mutually offset by at least one predefined angle (the angle of offset is not constant, but varies during the work cycle since, if there are two assemblies 3, the six arms are independent of each other).

With particular reference to the embodiment shown in the accompanying figures solely for the purpose of example (without this constituting any limitation on the scope of the inventive concept defined herein), it should be noted that the two assemblies 3 can be offset with respect to each other by an angle comprised between 150° to 180° (clockwise or anticlockwise).

It should be noted that, with particular reference to an embodiment of undoubted applicative interest (to which the accompanying figures refer), the at least two assemblies 3 are mutually coaxial, each arm 7, 8 and 9 of each assembly 3 therefore being rotatable, by way of the action of a respective motor device, with respect to a single common rotation axis 17.

According to an alternative embodiment that is equally advantageous in terms of implementation, the at least two assemblies 3 are mounted on a rotatable carousel, with axes not necessarily concentric and arranged substantially along the peripheral region of the carousel.

In such embodiment each arm 7, 8 and 9 of each assembly 3 will be rotatably pivoted, by way of the action of a respective motor apparatus, according to a specific axis, to the surface of the carousel, which in turn can rotate with respect to a central axis thereof.

In this second embodiment the arms therefore will protrude from the outline of the carousel and their rotations will determine corresponding movements of the bracket 4 with respect to the carousel. The carousel can furthermore rotate with respect to its central axis so as to define all the movements of the bracket 4 that are integral with the carousel.

In any case it should be noted that each motor apparatus and each motor device, i.e. all the components used to move the arms 7, 8 and 9 with respect to the respective pivoting axes, are of the type preferably chosen from among controlled electric motors, controlled brushless motors, actuation systems constituted by motors and camshafts and the like.

What is essential to note is that each arm 7, 8 and 9 can move independently of the others, so as to generate the desired law of motion for the bracket 4 by way of a specific combination of the simultaneous and independent movements of the arms 7, 8 and 9.

The station 1, in a particularly efficient embodiment thereof, comprises, along the path defined between the first and second configurations of the bracket 4 and adopting substantially conventional structures, a contrast element for forming/opening out a pre-glued sheet B picked up from the magazine 2 by the bracket 4.

The contrast element could be constituted by at least one sucker, arranged along the path of the sheet B while the bracket 4 is transferring it from the first to the second configuration: the suction circuit associated with the sucker can be activated upon the transition of the sheet B in order to produce the adhesion of the sucker to one of the surfaces of the sheet B. The advancement of the bracket 4 toward the second configuration, while the sucker of the contrast element is still coupled to the face of the sheet B, will determine a distancing of the face of the sheet B attached to the sucker with respect to the face of the sheet B coupled to the at least one grip means 5 of the bracket 4: this corresponding movement will ensure the transition from the squashed and substantially planar arrangement of the sheet B to a substantially tubular arrangement, corresponding to a box-like body open onto two mutually opposite fronts.

The possibility is not ruled out of using, instead of the sucker in the contrast element, movable tabs that can be arranged so as to interfere with the advancing sheet B transported by the bracket 4: in this case too, relative movement can determine a shaping of the sheet B.

According to an alternative and equally advantageous embodiment, the station 1 can comprise, at the delivery region 11, an abutment element 21 for forming/opening out the sheet: according to a possible embodiment, this could be the same teeth 10 that cooperate with the arms 7, 8 and 9.

In this case too, upon the approach of the bracket 4 which supports the pre-glued sheet B toward the delivery region 11, at least one portion of the sheet B will rest against the abutment element 21 with consequent forming/opening out of the sheet B as a result of the different speed of the bracket 4 with respect to the abutment element 21.

It should finally be noted that, in order to ensure that the delivery of each sheet A, B (with particular reference to the sheets A which, since they have larger dimensions, are more prone to the risk of an incorrect positioning) is precise and that the sheets A, B do not undergo accidental movements, the conveyance line 10 of the sheets A, B, in particular in the delivery region 11, comprises a suction belt 18 in order to immobilize the face of the sheet A, B delivered by the bracket 4.

Advantageously the present disclosure solves the above mentioned problems, by providing a station 1 for picking up and delivering shaped sheets A, B that define box-like bodies of different types, which is adapted to operate interchangeably on "flat sheets" A and on "pre-glued sheets" B.

Effectively the station 1 has a simple structure and shape, while having excellent versatility that makes it possible to operate on the two types of sheets A, B used in the packaging sector.

Positively the station 1 adopts universal movement means and therefore it does not require activities to change format (assembly and disassembly of mechanical parts): it will be sufficient to work on the software to modify the laws of motion of the arms 7, 8 and 9 (only if the arms 7, 8 and 9 are moved by way of cams will there be a need to carry out operations to substitute components).

Profitably the station 1 is different from conventional stations.

Conveniently the station 1 for picking up and delivering shaped sheets A, B that define box-like bodies of different types, described herein, is easily and practically implemented and has low costs, thus ensuring its safe application.

The disclosure, thus conceived, is susceptible of numerous modifications and variations. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

The disclosures in Italian Patent Application No. 102015000059424 (UB2015A004226) from which this application claims priority are incorporated herein by reference.

The invention claimed is:

1. A station for picking up and delivering shaped sheets that define box-like bodies of different types, of the type comprising a magazine for said sheets and at least one handling element for at least one sheet at a time, wherein said magazine accommodates a plurality of mutually aligned and juxtaposed sheets and said at least one handling element comprises an end bracket provided with at least one grip means and at least one assembly having arms articulated with respect to said bracket and are independently movable with respect to a fixed frame, said bracket being movable between a first configuration of alignment with the end sheet accommodated in said magazine, in the condition where said at least one grip means is in contact with said end sheet, and a second configuration of alignment with a conveyance line of said sheets which corresponds to a delivery region, each arm of each assembly being rotatable and independently movable with respect to the fixed frame of the station, by way of the action of a respective motor device, with respect to a single common rotation axis, said motor device being of the type chosen from among controlled electric motors, controlled brushless motors, actuation systems constituted by motors and camshafts, wherein said arms which are independently movable with respect to a fixed frame are three in number, two first arms being pivotally connected to respective linkages, each respective linkage having an end pivotally connected to said bracket to rotate about a common first rotation axis, a third arm being pivotally connected to a rod, the free end of the rod is rotatably engaged with said bracket about a second rotation axis.

2. The station according to claim 1, wherein said at least one grip means is of the suction type, of the type chosen from among a sucker and a substantially belt-shaped element with suction holes.

3. The station according to claim 1, wherein said assemblies with articulated arms are at least two in number, and are mutually offset by at least one preset angle.

4. The station according to claim 3, wherein said at least two assemblies are mutually coaxial, each arm of each assembly being rotatable, by way of the action of a respective motor device, with respect to a single common rotation axis.

5. The station according to claim 3, wherein said at least two assemblies are mounted on a rotatable carousel, each arm of each assembly being rotatably pivoted, by way of the action of a respective motor apparatus, according to a specific axis, to the surface of said carousel, which in turn is rotatable with respect to a central axis thereof.

6. The station according to claim 5, wherein said motor apparatus is of the type chosen from among controlled electric motors, controlled brushless motors, actuation systems constituted by motors and camshafts.

7. The station according to claim 1, wherein along the trajectory defined between the first and second configurations of said bracket, it comprises a contrast element for forming/opening out a pre-glued sheet picked up from said magazine by said bracket.

8. The station according to claim 1, comprising, at said delivery region, an abutment element for forming/opening out said one sheet, upon the approach of said bracket, supporting said pre-glued sheet, to said delivery region, at least one portion of said sheet resting against said abutment element with consequent forming/opening out of the sheet as a consequence of the different speed of said bracket with respect to said abutment element.

9. The station according to claim 1, wherein said conveyance line of said sheets, in particular in the delivery region, comprises a suction belt in order to immobilize a face of said sheet delivered by said bracket.

* * * * *